US006029473A

United States Patent [19]

Bravais

[11] Patent Number: 6,029,473

[45] **Date of Patent: *Feb. 29, 2000**

[54] PROCESS AND INSTALLATION FOR FILLING A RESERVOIR UNDER PRESSURE

[75] Inventor: Patrick Bravais, Fontaine, France

[73] Assignee: L'Air Liquide, Societe Anonyme pour l'Etude et l'Exploitation des Procedes Georges Claude, Paris Cedex, France

[ * ] Notice: This patent issued on a continued prosecution application filed under 37 CFR 1.53(d), and is subject to the twenty year patent term provisions of 35 U.S.C. 154(a)(2).

[21] Appl. No.: 09/069,843

[22] Filed: Apr. 30, 1998

[51] Int. Cl.[7] ..... F25J 1/00

[52] U.S. Cl. ..... 62/606; 62/925

[58] Field of Search ..... 62/606, 47.1, 50.2, 62/905, 904, 925

[56] References Cited

U.S. PATENT DOCUMENTS

| | | | |
|---|---|---|---|
| 2,194,654 | 3/1940 | Hadamovsky | 62/606 |
| 2,291,288 | 7/1942 | Rudd . | |
| 4,175,395 | 11/1979 | Prost et al. | 62/50.2 |
| 4,575,386 | 3/1986 | Hamers | 62/606 |
| 4,646,525 | 3/1987 | Delacour et al. | 62/51.1 X |
| 5,327,729 | 7/1994 | Yanai et al. | 62/606 |

FOREIGN PATENT DOCUMENTS

| | | |
|---|---|---|
| 44 17 106 | 11/1995 | Germany . |
| 196 16 811 | 11/1996 | Germany . |
| 987019 | 3/1965 | United Kingdom . |

*Primary Examiner*—Christopher B. Kilner
*Attorney, Agent, or Firm*—Young & Thompson

[57] ABSTRACT

A reservoir is filled under pressure with a gas, by introducing a quantity of a gas into an intermediate receptacle (3), liquefying this quantity of gas, upon its introduction into the intermediate receptacle, by heat exchange with a refrigerant fluid, reheating and vaporizing this quantity of gas in the intermediate receptacle by thermal contact with a heat source (15), and placing in fluid communication the intermediate receptacle and the reservoir (2) when the pressure in the intermediate receptacle becomes greater than the pressure in the reservoir.

15 Claims, 2 Drawing Sheets

PROCESS AND INSTALLATION FOR FILLING A RESERVOIR UNDER PRESSURE

CROSS REFERENCE TO RELATED APPLICATION

This application corresponds to French application 97 12433 of Oct. 6, 1997, the disclosure of which is incorporated herein by reference.

FIELD OF THE INVENTION

The invention relates to a process and an installation for filling a reservoir under pressure with a gas.

BACKGROUND OF THE INVENTION

In space applications, it is known to use a reservoir filled with xenon for the plasmic propulsion of satellites, such a reservoir having to be filled, for reasons of safety, just before launching the satellite. This reservoir is filled at a pressure of the order of 180 bars. The installation permitting such filling, sometimes called a "filling skid", must be light and small size, because it is transported to the launching pad near the launchers.

To fill a reservoir with xenon at high pressure, there exists several known processes. One can proceed to the filling with a mechanical compressor, preferably of the membrane type, to avoid any pollution. Membrane compressors are very heavy and permit only low flow rates of gas, such that the filling of a reservoir can take a very long time. It is also possible to proceed to filling with a hydropneumatic supercharger. However, such superchargers have the risk of polluting the gas, which is not permissible for certain intended applications, particularly in the space field. One could fill the reservoir whilst immersing it in a bath of liquid nitrogen so as to liquefy the xenon. This method is not suitable for reservoirs that are composite or of plain steel, nor for reservoirs already integrated into a structure such as for example a satellite. There could also be envisaged heating the master container of the gas, but this method is applicable only if the volume of the reservoir to be filled is much less than that of the master cylinder.

SUMMARY OF THE INVENTION

The invention seeks to provide a process and an installation for filling a reservoir under pressure which overcomes the mentioned drawbacks of the prior art and permits reliable filling, which can be used on a launching pad, without risk of polluting the xenon.

To this end, the invention relates to a process for filling a reservoir under pressure with a gas, characterized in that it consists in:

- introducing a quantity of said gas into an intermediate receptacle,
- liquefying said quantity of gas during its introduction into said intermediate receptacle, by heat exchange with a refrigerant fluid,
- reheating and vaporizing said quantity of gas in said intermediate receptacle by heat exchange with a warm source,
- placing in fluid communication said intermediate receptacle and said reservoir when the pressure in the intermediate receptacle becomes greater than the pressure of the reservoir.

Thanks to the invention, the intermediate receptacle serves as a thermal compressor, which is to say permits raising the pressure of the gas relative to its pressure in a source such as a master cylinder. This thermal compressor is light, efficient relative to the other solutions, and has no moving part, which is a criterion of good reliability.

According to a first preferred aspect of the invention, the process also consists in heating the quantity of gas in the intermediate receptacle, after placing in fluidic communication the intermediate receptacle and the reservoir. Thanks to this aspect of the invention, when the intermediate receptacle and the reservoir have been placed in communication, the maintenance of continued heating leads to a warming up of the quantity of gas comprised in the intermediate receptacle, which permits continuously discharging toward the reservoir this quantity of gas which is thus under high pressure.

According to another preferred aspect, the transfer of gas from the intermediate receptacle to the reservoir takes place at substantially constant pressure.

The refrigeration liquid used with the process of the invention is preferably a liquid nitrogen whose industrial production is well known.

The invention also relates to an installation permitting practicing the process of the invention and, more particularly, to an installation which comprises at least one thermal compressor comprised by an intermediate receptacle disposed between a source of gas and the reservoir, this thermal compressor comprising means for liquefaction by cooling a quantity of gas in the course of introduction into the intermediate receptacle and means for heating this quantity of gas within the intermediate receptacle.

According to a first preferred aspect, the liquefaction means comprise a tube for circulation of a cooling liquid such as particularly liquid nitrogen. These liquefaction means are known per se and relatively easy to use.

According to another preferred aspect of the invention, the heating means of the quantity of gas comprised in the intermediate receptacle comprise an electric heating element. The use of an electric heating element permits rapid heating of the quantity of gas comprised in the intermediate receptacle, and hence a substantial reduction of the cycle time for a filling operation relative to the prior art.

According to another preferred aspect, the circulation tube and the electric heating element are disposed within the intermediate receptacle. Thus only a small portion of the thickness of the thermal compressor wall will experience temperature reduction or increase as a function of that of the fluid contained, such that the thermal inertia of the compressor is reduced.

Preferably, the intermediate receptacle comprises a gas inlet in its lower portion and a gas outlet at its upper portion. This permits withdrawing gas from the portion of the intermediate receptacle in which the gas temperature is highest.

According to another preferred aspect of the invention, the intermediate receptacle can enclose a dish for receiving liquefied gas, this dish being spaced from the internal wall of the receptacle. Thanks to this aspect of the invention, the thermal inertia of the compressor is likewise decreased.

The invention also relates to an installation which comprises two thermal compressors adapted to operate in opposition, one working for liquefaction of a quantity of gas whilst the other works for the vaporization-compression of another quantity of gas. This permits carrying out the liquefaction operations in overlapping fashion, and hence decreasing the total time for an operation of filling a reservoir.

BRIEF DESCRIPTION OF THE DRAWINGS

The invention will be better understood and other advantages of it will become more apparent from the description which follows of one embodiment of a filling installation for a reservoir according to its principle and of its process of practice, given solely by way of example and with reference to the accompanying drawings, in which.

DETAILED DESCRIPTION OF THE INVENTION

Figure 1:
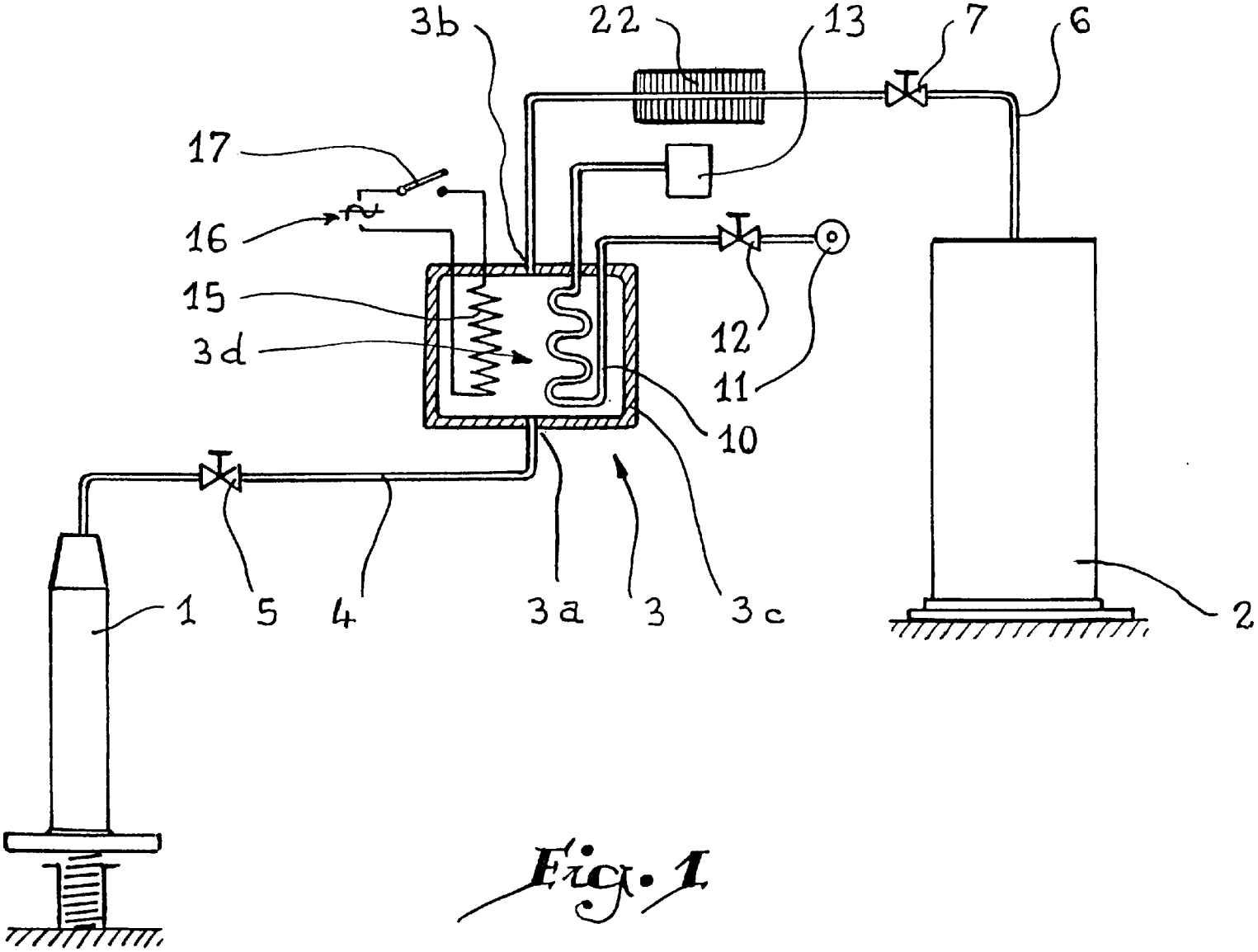
FIG. 1 is a flow diagram of a filling installation according to the invention.

In FIG. 1, a master cylinder 1 contains a quantity of xenon, for example 50 kg, under a pressure of the order of 60 bars at 20° C. The purpose of the installation is to fill a reservoir 2 of titanium, steel or carbon, adapted to be carried by a satellite, at a pressure comprised between about 80 and 300 bars, for example of the order of 180 bars.

To do this, the installation comprises an intermediate receptacle 3 whose inlet 3*a* is connected by a conduit 4 through a valve 5, to the master cylinder 1. Similarly, a conduit 6 connects the outlet 3*b* of the intermediate receptacle 3 to the reservoir 2 through a valve 7. The receptacle 3 comprises a chamber 3*c* defining an internal volume 3*d* of the receptacle 3, of the order of several liters, for example about 4 liters. In this interior volume 3*d* is disposed a tube 10 within which circulates the liquid nitrogen from a source 11 such as a demijohn of liquid nitrogen. A valve 12 is provided for controlling the supply of the tube 10 from the source 11. A collector member 13 is provided to receive the liquid or gaseous nitrogen after it has circulated through the tube 10.

An electric reheater, such as for example a heating resistance 15, is also disposed within the volume 3*d* and connected to a power source 16 which is controlled by a switch 17.

Figure 2:
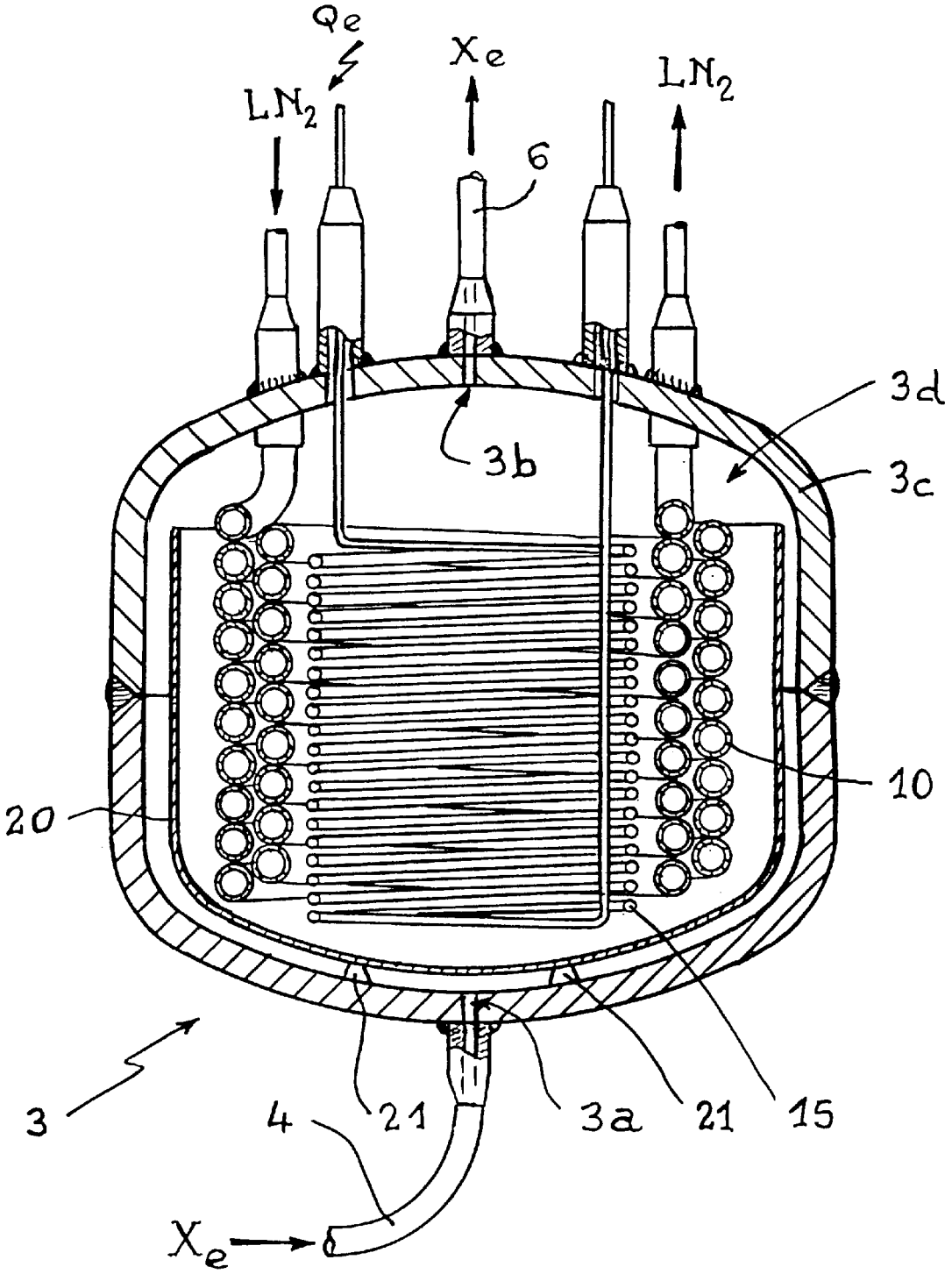
FIG. 2 is a vertical cross section of a thermal compressor used in the installation of FIG. 1.

As will be seen more clearly from FIG. 2, the tube 10 is wound in a spiral with a substantially vertical axis, whilst the heating element 15 is also wound in spiral form within the volume 3*d* about the same axis.

A dish 20 is disposed within the intermediate receptacle 3 about the tube 10 whilst being maintained at a distance from the internal wall of the chamber 3*c* by spacers 21. This dish 20 is adapted to receive the liquefied gas, such that the latter is maintained at a distance from the chamber 3*c*, which permits reducing the heat exchange and hence the thermal inertia of the receptacle 3.

It will be noted that the inlet 3*a* for xenon is disposed in the lower portion of the intermediate receptacle 3, whilst the outlet 3*b* is disposed in the upper portion.

In FIG. 2, the arrows $LN_2$ indicate the direction of circulation of nitrogen, the arrows $X_e$ indicate the direction of circulation of xenon and the arrow $Q_e$ indicate the quantity of electricity supplied to the resistance 15.

The operation of the installation results from the preceding explanation. When it is desired to fill the reservoir 2 from the demijohn 1 containing xenon, the valve 7 being closed, the valve 5 is opened to place into communication the master cylinder 1 and the intermediate receptacle 3, such that the gas is discharged from the cylinder 1 toward the reservoir 3. During arrival of the gas in the reservoir 3 the latter is liquefied by contact with the tube 10 in which circulates liquid nitrogen at about −180° C. The diameter of the tube 10 and the speed of flow of the liquid nitrogen in this tube are calculated such that the consumption of liquid nitrogen will not be too great and such that the nitrogen leaves the intermediate receptacle 3 at a temperature near the saturation temperature of the xenon, namely 165° K at 1 bar. In practice, the nitrogen flow rate in the tube 10 is comprised between 2 and 20 g/s.

There is thus obtained a quantity of liquefied nitrogen collected in the dish 20 within the intermediate receptacle 3.

The valve 5 and the switch 17 are then closed, such that the circulation of current in the resistance 15 results in a rapid rise in the temperature of the xenon contained in the reservoir 3. This leads to vaporization of the liquefied gas, then a compression of this gas within the receptacle 3, this compression permitting rapidly achieving a pressure of the order of 180 bars. The intermediate receptacle 3 thus constitutes a "thermal compressor" permitting raising the temperature of a gas and having no moving part.

When a pressure of the order of 180 bars is reached, the valve 7 is open so as to place in fluid communication the receptacle 3 and the reservoir 2. The gas is thus discharged into the reservoir 2.

The switch 17 is kept closed, such that heating continues within the intermediate receptacle 3, which tends to increase the internal pressure of the reservoir 3, the gas being then progressively evacuated. Thus, the discharge of the gas from the intermediate receptacle 3 into the reservoir 2 takes place whilst the pressure within the intermediate receptacle is maintained substantially constant, or even slightly increased.

Tests have been conducted that show that, during isochor compression of the quantity of gas by heating in the receptacle 3, the temperature of the xenon rises from about 210° K to about 245° K. Continued heating after opening of the valve 7 permits increasing the temperature of the vaporized xenon from about 245° K to about 310° K.

A high thermal inertia exchanger 22 is disposed about the conduit 6. This exchanger, which can be formed of a block of aluminum, is adapted to receive, at its inlet, a gas between −30° C. and 40° C. and to deliver at its outlet a gas at about 5° C. This permits supplying the reservoir 2 at a temperature higher than 5° C. and to avoid any risk of condensation in or on the external surface of the reservoir 2.

Moreover, continued heating when the receptacle 3 is in communication with the reservoir 2 leads to the creation of a relatively great temperature gradient within the thermal compressor, the hottest gas having the tendency to accumulate adjacent the outlet opening or exit 3*b* which is located in the upper portion, which facilitates its transfer to the reservoir 2.

The thermal compressor or intermediate receptacle 3 must be able to withstand low temperatures when the gas is liquefied, but also must be dimensioned as a function of the temperature at which the reservoir 2 must be filled. The thickness of the chamber 3*c* is determined as a function of these criteria. The thermal inertia of the compressor must be as low as possible so as not to worsen the performance of the process and in particular the cycle time.

The volume of the compressor must be sufficiently great to permit placing therein the tube 10 and the heating element 15, but sufficiently small to limit the thermal inertia. A volume of several liters, particularly 4 to 6 liters, permits filling a reservoir of several tens of liters in several tens of cycles. In this case, the wall of the thermal compressor 3 can have a thickness of the order of about 10 mm, its total mass being of the order of about 30 kg.

Preferably, the compressor is provided with a pressure detector and a temperature detector, which are not shown in the drawings, so as to confirm the good operation of the device. To the same end, the thermal compressor 3 can be installed on a balance.

The power consumed by the heating element 15 is not necessarily very great as the quantity of fluid which must be heated for each cycle is relatively low. In practice, a heating element with a nominal power of the order of several kilowatts, for example between 2 and 4 kW, is sufficient.

Moreover, several compressors can be used in parallel to increase the total flow rate of the installation. Particularly, there can be used two thermal compressors operating in opposition, one working on the liquefaction of a quantity of gas whilst the other works on the vaporization-compression of another quantity of gas.

According to a modification of the invention (not shown), the heating element 15 could be replaced by a water exchanger or any other fluid with high heat capacity. Of course, the arrangement of the inlets 3*a* and 3*b,* as well as the arrangement of the inlet and outlet of the tube 10 and of the inlet and outlet of the heating element 15, could be modified. Similarly, a refrigeration system with a fluid having a vaporization temperature near 200° K could be used in place of the tube 10 containing liquid nitrogen.

The invention has been described in connection with an installation for filling a reservoir with xenon. It is of course applicable to other gases with relatively high critical temperature, particularly krypton.

A particular application of the invention is the filling on the ground of a xenon reservoir having a purity above 99.995%, this xenon being utilized for plasmic propulsion of satellites. It will be understood that the installation of the invention can constitute a light and compact assembly which can be easily moved onto the launching pad of these satellites.

The invention can also be used in installations for the recovery of xenon or krypton, for example in the lamp industry.

What is claimed is:

1. A process for filling a reservoir with a gas under an elevated pressure, comprising:

introducing a quantity of said gas into an intermediate vessel;

liquefying said quantity of gas, in said intermediate vessel, by heat exchange with a refrigerant fluid so as to obtain a quantity of liquefied gas;

reheating and vaporizing said quantity of liquefied gas in said intermediate vessel by supplying heat into said intermediate vessel; and establishing fluid communication between said intermediate vessel and said reservoir when the pressure in said intermediate vessel becomes greater than said elevated pressure so as to transfer gas from said intermediate vessel to said reservoir.

2. The process of claim 1, wherein the step of supplying heat into said intermediate vessel is prolongated at least temporarily after the intermediate vessel and said reservoir have been placed in fluid communication one with each other.

3. The process of claim 1, wherein the transfer of gas from said intermediate vessel to said reservoir takes place under substantially constant pressure.

4. The process of claim 1, wherein said heat exchange with a refrigerant liquid is achieved by circulating liquid nitrogen into said intermediate vessel.

5. The process of claim 1, wherein said gas is a rare gas.

6. The process of claim 5, wherein said rare gas is xenon.

7. A device for filling a reservoir with a gas under pressure, comprising at least one thermal compressor including a vessel selectively connectable to a source of said gas and to said reservoir, and encompassing cooling means adapted to liquefy a quantity of said gas introduced into said vessel and heating means adapted to heat said quantity of gas within said vessel.

8. The device of claim 7, wherein said cooling means comprise a fluid circuit for circulating a cooling fluid within the vessel.

9. The device of claim 8, wherein said heating means comprise an electric heating circuit within the vessel.

10. A device according to claim 9, wherein said fluid circuit and said electric heating circuit are disposed concentrically within said vessel.

11. The device of claim 10, wherein said vessel comprises an inlet in its lower portion for connection to said gas source and an outlet in its upper portion for connection to said reservoir.

12. The device of claim 7, wherein said vessel has an outer envelope and an internal dish for collecting said liquefied gas, said dish being spaced from the envelope.

13. The device of claim 7, wherein said gas is xenon and said vessel has an inner volume not less than 4 liters.

14. A device according to claim 7, which comprises two thermal compressors adapted to operate in phase phase opposition, one working for the liquefaction of a quantity of gas whilst the other works for the vaporization-compression of another quantity of gas.

15. An installation for filling a reservoir with a gas under pressure, comprising:

at least one thermal compressor having an inlet conduit including a first valve and an outlet conduit including a second valve;

said inlet conduit being fluidly connected to a source of gas, and said outlet conduit being fluidly connected to a reservoir;

cooling means disposed within said thermal compressor for liquefying a quantity of gas introduced in said thermal compressor; and heating means disposed within said thermal compressor for vaporizing a quantity of liquefied gas.

* * * * *

UNITED STATES PATENT AND TRADEMARK OFFICE

CERTIFICATE OF CORRECTION

PATENT NO. : 6,029,473

DATED : February 29, 2000

INVENTOR(S) : Patrick BRAVAIS

It is certified that error appears in the above-indentified patent and that said Letters Patent is hereby corrected as shown below:

On the title page, insert Item [30] as follows:

--[30] Foreign Application Priority Data

Oct. 6, 1997 [FR] France.....9712433--.

Signed and Sealed this

Sixth Day of February, 2001

*Attest:*

*Attesting Officer*

Q. TODD DICKINSON

*Director of Patents and Trademarks*